United States Patent [19]

McCollum et al.

[11] Patent Number: 4,584,088

[45] Date of Patent: Apr. 22, 1986

[54] METHOD FOR TREATING SHALE

[75] Inventors: John D. McCollum, Naperville; William F. Wolff, Park Forest, both of Ill.

[73] Assignee: Standard Oil Company (Indiana), Chicago, Ill.

[21] Appl. No.: 630,368

[22] Filed: Jul. 12, 1984

[51] Int. Cl.[4] ..... C10G 1/04

[52] U.S. Cl. ..... 208/11 LE; 423/121; 423/130; 423/131

[58] Field of Search ..... 208/11 LE, 11 R; 423/121, 130, 131, 132, 338

[56] References Cited

U.S. PATENT DOCUMENTS

| | | | |
|---|---|---|---|
| 3,238,038 | 3/1966 | Hunter | 208/11 LE |
| 3,503,705 | 2/1970 | Tuckett | 208/11 LE |
| 3,516,787 | 6/1970 | Van Nordstrand | 208/11 LE |
| 3,607,777 | 9/1971 | Winyall et al. | 423/131 |
| 3,721,730 | 3/1973 | Haas | 423/131 |
| 3,821,353 | 6/1974 | Weichman | 423/119 |
| 4,264,564 | 4/1981 | Friedmann et al. | 423/339 |
| 4,408,999 | 10/1983 | Nadkarni et al. | 208/11 LE |
| 4,490,238 | 12/1984 | Siskin | 208/11 LE |
| 4,491,513 | 1/1985 | Siskin | 208/11 LE |
| 4,491,514 | 1/1985 | Siskin | 208/11 LE |

*Primary Examiner*—John Doll
*Assistant Examiner*—A. Pal
*Attorney, Agent, or Firm*—John B. Goodman; William T. McClain; William H. Magidson

[57] ABSTRACT

A method for producing a kerogen concentrate from oil shale comprises treating shale with a first aqueous caustic treating solution to produce a shale product of substantially transformed mineral content, and then treating the shale product with an aqueous acid solution to produce a first kerogen concentrate. The acid solution extracts minerals from the shale product to make a low ash content first kerogen concentrate. A spent acid solution containing the extracted minerals can be treated to recover minerals therefrom. The first kerogen concentrate is then treated with a second aqueous caustic treating solution to produce a second kerogen concentrate of lower ash content. The first and second aqueous caustic treating solutions are preferably the same.

16 Claims, 3 Drawing Figures

METHOD FOR TREATING SHALE

FIELD OF THE INVENTION

The invention relates generally to chemical treatments of oil shale rock to facilitate extraction of kerogen and minerals contained in the shale ore. More specifically, it relates to a method for treating shale with an aqueous caustic solution under conditions sufficient to substantially transform minerals present in the shale into extractable forms to produce a shale product which is converted into a kerogen concentrate by treatment in an acid digestion followed by a second caustic digestion.

BACKGROUND OF THE INVENTION

Oil shale rock represents a large hydrocarbon resource base from which energy can be recovered. The hydrocarbon constituents in shale rock are known as kerogen which is a mixture of hydrocarbons, in either dry or solidified form, produced by sedimentation of organic substances. The kerogen is contained within the interstices of the shale rock matrix and is generally about 15–25 weight percent of the rock. The kerogen is typically converted into shale oil by high temperature retorting of shale. Shale rock also contains other valuable inorganic mineral values such as uranium, copper, nickel, cobalt, molybdenum, vanadium, titanium, iron and aluminum. For example, western Colorado shale generally contains about 3 to about 6 wt. percent aluminum.

Because of the value of shale's kerogen and minerals, methods for extracting kerogen or the minerals are important. Thus, chemical treating methods other than retorting for concentrating the kerogen contained in oil shale have been disclosed. Chemical treatments of oil shale to recover mineral values contained in the shale have also been disclosed.

For example, Hunter, U.S. Pat. No. 3,238,038 discloses a method for recovering a precious metal such as gold and silver from a bituminous shale ore by treating the shale with an aqueous alkaline solution to increase solubility of the precious metal in an aqueous acid solution. The insoluble residue from the alkaline digestion step is then separated and contacted with an aqueous acid solution, which must contain sulfate, nitrate, chloride and iron ions. A solution containing the precious metal is then separated. Hunter does not disclose a technique for concentrating the kerogen in shale nor a technique for recovering minerals other than precious metals.

Huang, U.S. Pat. No. 4,069,296, discloses a method for recovering aluminum from raw or spent oil shale by contacting the shale with aqueous hydrochloric acid, removing the insoluble residues from the acid treating solution, and then precipitating hydrated aluminum hydroxide from the acid treating solution by contacting with an alkaline agent.

Haas, U.S. Pat. No. 3,859,413 extracts some of the alumina from a previously retorted dawsonite-bearing oil shale. Dawsonite is a sodium aluminum carbonate mineral, $NaAlCO_3(OH)_2$, having aluminum concentrations greater than 4 weight percent. Haas employs a dilute alkaline leaching solution containing 5 to 25 grams solid caustic per liter, at temperatures of 5° to 40° C. for short leach periods up to 1 minute.

Rust, et al., U.S. Pat. No. 4,130,627, discloses a method for recovering minerals from fly ash, not shale, by treating a fly ash water slurry with a sodium hydroxide solution at pH 11–14, recovering a solid residue, and then leaching the solid residue with hydrochloric or hydrofluoric acid to form dissolved chloride or fluoride salts of iron, aluminum, and other metals. The solution containing the dissolved salts is then electrolized to plate out at least iron and optionally one or more other metals, and to recover silicon dioxide by precipitation from the electrolysis solution. The electrolysis solution free of silicon dioxide is then treated to precipitate aluminum hydroxide by raising the pH of the electrolysis solution.

Drinker, U.S. Pat. No. 4,026,360, discloses an in situ method for producing a shale oil from a subterranean oil shale deposit. The method comprises contacting the shale deposit with a hot aqueous alkaline solution to form clay-like materials in the deposit which can swell when subsequently contacted with water. Fresh water relatively free of electrolytes is then injected into the deposit to form flow barriers and reduce permeability of the shale deposit. The flow barriers then direct the flow of subsequently injected fluids to produce shale oil. Drinker does not disclose a kerogen concentration method.

Fahlstrom, U.S. Pat. No. 4,176,042, discloses a method for recovering kerogen from bituminous sedimentary rock by crushing and finally dividing the rock in a plurality of grinding stages to a sufficient fineness to free the major part of the kerogen present in the rock. The kerogen can then be separated from the rock by emulsification, flotation or density-separation processes. To enable the rock to be finely divided more readily, the rock at least prior to the final one of the grinding stages is subjected to a leaching treatment to weaken mechanical bonds between minerals contained in the sedimentary rock. The leaching treatment is performed at temperatures above 50° C. with acid solutions, "although basic solutions may also be used". Fahlstrom discloses chemical treating only as an aid to a physical separation of kerogen by grinding of the shale rock. Moreover, acid and basic solutions are disclosed as equivalent for kerogen concentration, but acid solutions are preferred by Fahlstrom.

International Patent Application No. WO 82/03484, Meyers et al., assigned to TRW, Inc., published Oct. 14, 1982, and titled "Extraction and Upgrading of Fossil Fuels Using Fused Caustic and Acid Solutions" describes a two-step treating method for raw shale ore. The oil shale is first contacted with a fused alkali at a temperature within the range of 250°–400° C. The solid residue obtained is then washed with a dilute aqueous acid solution to obtain a kerogen concentrate. In this method, the severity of the fused alkali treating conditions is such that no water is present in the treating solution nor is any water maintained within the shale being treated. In addition, there is no disclosure of mineral recovery carried out in conjunction with the kerogen concentration.

Applicants' copending application, Ser. No. 541,720, "Method for Treating Shale", filed Oct. 13, 1983, and incorporated by reference, discloses digesting shale with a caustic solution under conditions sufficient to substantially transform the minerals of the shale into extractable forms without substantial extraction of the minerals into the caustic treating solution. The resulting shale product is then converted into a kerogen concentrate by an acid digestion. However, additional mineral removal from this kerogen concentrate can be desirable.

There are also numerous disclosures involving treating shale which has been previously retorted, roasted, or pyrolyzed with acid or base solutions. Typical such disclosures are found in Van Nordstrum, U.S. Pat. No. 3,389,975; Hite, U.S. Pat. No. 3,481,695; Paul et al., U.S. Pat. No. 3,510,255; Van Nordstrum, U.S. Pat. No. 3,516,787; Templeton, U.S. Pat. No. 3,572,838; Ellington, U.S. Pat. No. 3,586,377; Hoss, U.S. Pat. No. 3,859,413. For example, Hite, U.S. Pat. No. 3,481,695 discloses a process in which oil shale is mixed with sodium carbonate or bicarbonate salt, the resulting mixture is retorted to drive off the shale oil, and the solid residue is then leached with water or dilute acid or base to extract some of the aluminum values from the solid residue.

Applicants are not, however, aware of any integrated method for concentrating kerogen contained in raw or spent shale in conjunction with recovering the mineral values contained within the shale. The disclosed methods also do not focus on obtaining a kerogen concentrate of reduced ash content. Therefore, one object of the invention is to obtain an improved kerogen concentrate of reduced mineral content as measured by its ash content. Another object is to recover minerals such as aluminum contained within the shale rock to improve the economics of the treating method. Other objects appear below.

SUMMARY OF THE INVENTION

The invention comprises a method for treating oil shale containing kerogen by digesting the shale with a first aqueous caustic treating solution under conditions sufficient to transform minerals present in the shale to extractable form to produce a shale product of substantially transformed mineral content; treating the shale product with an acid solution to produce a first kerogen concentrate; and treating the first kerogen concentrate with a second aqueous caustic treating solution to produce a second kerogen concentrate.

The shale digestion sequence of the invention has the advantage of maximizing the eventual removal of minerals from the shale to produce the second kerogen concentrate of low ash content which can then be retorted in a much smaller retort because of the mineral removal. The second caustic digestion maximizes the mineral removal by using less severe conditions than the first caustic digestion. Moreover, the invention has the advantage of high mineral recovery to improve the economics of shale treating because the shale minerals are not substantially extracted into the concentrated aqueous caustic solution from which mineral removal is more costly. Instead, the invention permits the minerals in the shale product to be extracted with a dilute acid solution from which mineral recovery is easier. For example, aluminum can be recovered in high yields with the invention from shales which previously were not susceptible to aluminum extraction. Finally, the caustic-acid-caustic digestion of the invention permits use of less concentrated caustic solutions to further reduce costs.

In one aspect the invention comprises contacting raw shale with an aqueous caustic treating solution having a caustic concentration of about 10 to about 60 weight % at a pressure of about atmospheric to about 250 psi to transform minerals present in the shale into acid extractable form and produce a shale product having a substantially transformed mineral content; treating the shale product with an aqueous acid solution to extract minerals from the shale product and produce a first kerogen concentrate; and treating the first kerogen concentrate with the aqueous caustic treating solution to produce a second kerogen concentrate. If desired, the mineral-containing acid solution is then subjected to further separation techniques for minerals recovery, and the acid and caustic treating solutions can be regenerated if necessary.

DETAILED DESCRIPTION OF THE INVENTION

Figure 1:
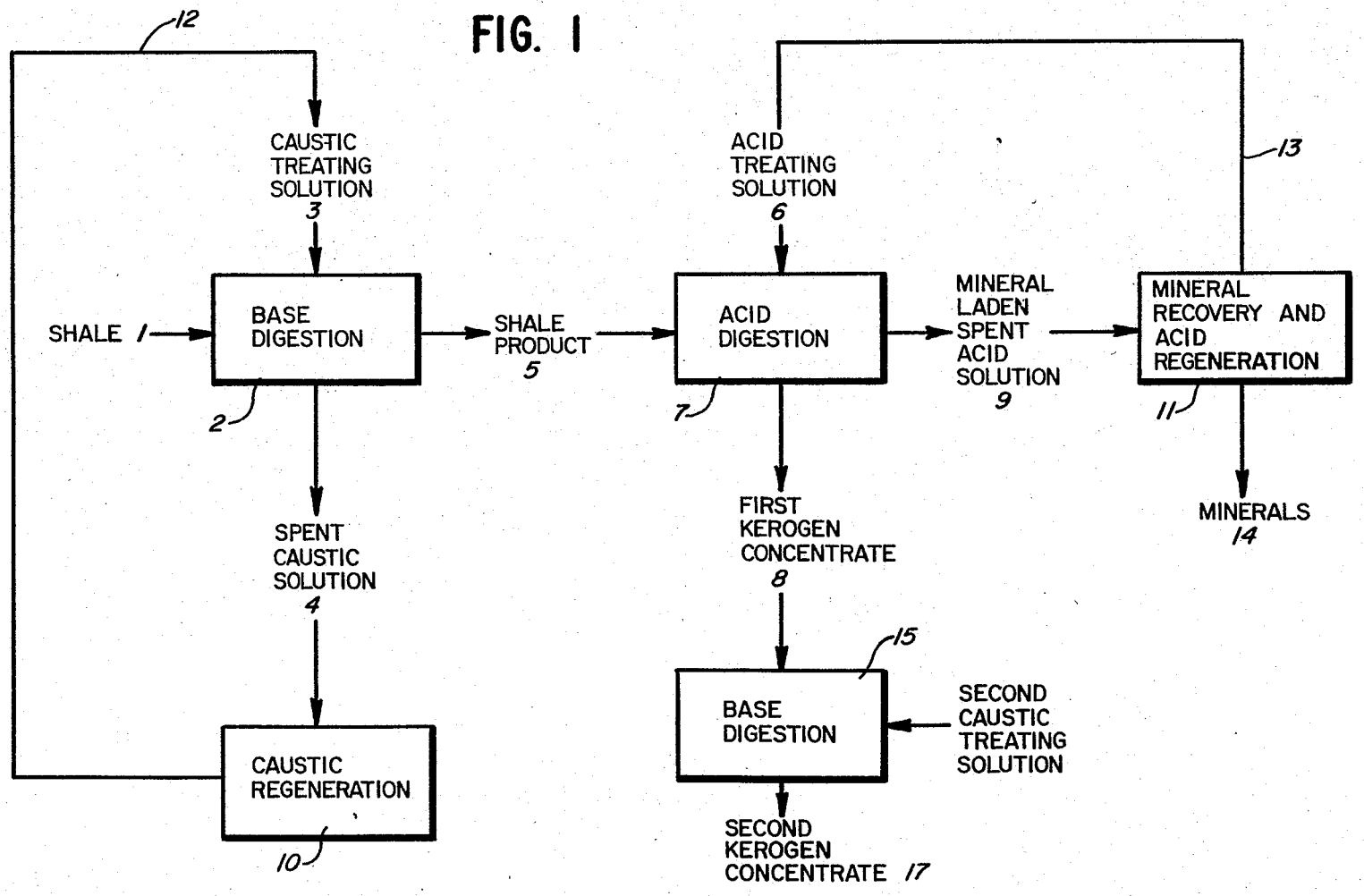
FIG. 1 shows a shale treating method according to the invention.

This invention comprises a method for treating shale rock containing kerogen. The shale starting material can be raw shale which has been mined in a conventional manner. Raw shale from many different deposits can be treated according to the invention. Shale which has been previously beneficiated to upgrade kerogen content or treated to extract kerogen can also be used as the starting material. For example, spent shale from a retort or shale beneficiated in a flotation process which removes gangue material from the shale can be used. It is preferred, however, to use raw shale as the starting material.

The invention comprises digesting shale ore with a first aqueous caustic treating solution under conditions which are sufficient to transform minerals present in the shale into extractable forms without substantial extraction of the minerals into the caustic treating solution to produce a shale product of substantially transformed mineral content; digesting the shale product with an acid solution to produce a first kerogen concentrate of low ash content; and treating the first kerogen concentrate with a second caustic treating solution to produce a second kerogen concentrate of lower ash content.

A low ash content in the kerogen concentrate is highly desirable because the size of retort to process the concentrate is related to ash content. Decreases in ash content lower the retort size at significant cost savings. The second caustic treating disclosed uses less severe treating conditions than the first caustic digestion, thereby further reducing the ash content of the first kerogen concentrate at low additional costs.

Applicants have found that the treating conditions in the first caustic digestion determine ash content of the shale product which determines ash content of the first kerogen concentrate. This is so because the ash content of the first kerogen concentrate depends on the amount of minerals left unextracted in the concentrate, and the amount of unextracted minerals in turn depends on the effectiveness of the treating conditions in the caustic digestion for transforming the minerals into extractable forms. Furthermore, the ash content of the second kerogen concentrate depends on the extent of mineral extraction by the second caustic digestion. In short, the greater the mineral extraction, the lower the ash content in the first and second kerogen concentrate.

The caustic treating conditions in the first digestion are controlled by maintaining water concentration during the caustic digestion within specified limits. The water concentration, which includes both water present in the caustic treating solution and water present in the shale being digested, determines the amount of minerals which are transformed into extractable forms. For example, sufficient water must be present to produce extractable cancrinite, a hydrated alumina-silicate, and other extractable minerals from the unextractable alumina minerals present in shale. The method of the invention therefore maintains the water concentration at least about 5 to about 90 weight %, and preferably within about 40 to about 90% by control of caustic concentration in the caustic treating solution, of digestion pressures and of digestion temperature. By such control of the water concentration, a first kerogen concentrate with a reduced ash content can be produced with concomitant recovery of the extracted minerals. The preferred water concentration of about 40 to 90% corresponds to 10 to 60% caustic, and is preferred because of lower chemical costs. The higher caustic concentrations in the caustic digestion used in Applicants' co-pending application can be used here in the first caustic digestion, but are not preferred because the three step digestion sequence disclosed herein accomplished good mineral removal and thus low ash content in the final kerogen concentrate.

This significance of the water concentration is illustrated in Examples 1–20 and FIG. 3, which are discussed below. Briefly, in these examples shale was treated at atmospheric pressure with a 50% aqueous caustic treating solution in the caustic digestion, and the water loss during the digestion was measured. The first kerogen concentrates with lower ash contents resulting from acid digestion of the shale products were seen in those examples where the water concentration, as measured by water lost during the digestion, was within about 10 to about 18%.

As noted, one purpose of the caustic digestion is to transform the minerals contained in the matrix of the shale rock to a different form in the resulting shale product. Then, additional treating of the shale product extracts the minerals to produce the second kerogen concentrate of low ash content which can be upgraded directly in a retort.

The additional treating begins with an acid digestion wherein the shale product having a substantially transformed mineral content obtained from the first caustic digestion is treated with an aqueous acid solution. The acid solution extracts minerals in ionic form from the shale product into the acid treating solution. The residue separated from a spent acid treating solution containing the minerals is the first kerogen concentrate which has a reduced ash content due to the mineral extraction. The first kerogen concentrate is then treated with a caustic solution, which may be the same as that used in the first caustic digestion, to produce the second kerogen concentrate. The caustic treatment of the first kerogen concentrate is not as severe as the first caustic digestion.

In a further aspect the spent acid treating solution which contains the minerals is processed to recover the minerals and to regenerate the acid solution. The mineral recovery and acid regeneration can be performed in conjunction with regeneration of the spent caustic treating solution.

FIG. 1 illustrates the caustic then acid then caustic digestion sequence of the invention. Here, shale 1 is shown as feed to caustic digestion 2, and a first caustic treating solution 3 is fed into the caustic digestion where it contacts the shale. The minerals in the shale are substantially transformed by the digestion into an extractable form, but the minerals are not substantially extracted into the caustic treating solution.

The resulting shale product 5 having a transformed mineral content is separated from the spent caustic solution 4. The spent caustic solution is regenerated in caustic regeneration 10. Caustic 12 from the caustic regeneration is used to make additional caustic treating solution 3.

The shale product 5 is fed to acid digestion 7 where it is contacted with dilute aqueous acid solution 6, and the minerals in the shale product are extracted into the acid treating solution. The kerogen concentrate 8 is separated from the mineral laden spent acid solution 9. The mineral laden acid solution is sent to mineral recovery and acid regeneration 11. Here minerals 14 are recovered and the acid treating solution 13 is regenerated.

The first kerogen concentrate 8 is sent to an additional caustic digestion 15 for further removal of silica by contact with a second caustic treating solution 16, which can be the same as the first caustic treating solution 3. The product second kerogen concentrate 17 is separated and contains a still lower ash content.

To prepare the aqueous caustic treating solutions of the invention, Group 1 or Group 2 metal hydroxides such as sodium, lithium, potassium, or calcium hydroxide can be used. Other alkaline materials such as sodium sulfide, sodium tetrasulfide, sodium hydrosulfide, sodium carbonate, sodium bicarbonate, and sodium silicate can also be used as the caustic to prepare the caustic treating solution. However, sodium hydroxide is preferred because it is easier to subsequently regenerate sodium hydroxide solution for additional treatments of fresh shale than to regenerate other caustic solutions. Calcium hydroxide, for example, may entail operating problems in the regeneration due to the formation of calcium sulfate where sulfate ions are present.

The concentration of caustic on a dry solids weight basis in the first aqueous caustic treating solution is that amount which yields a treating solution containing about 5 to about 90 weight % water. The caustic concentration also can vary with digestion pressure, with higher pressures accompanying lower caustic concentrations. It is preferred to use about 10 to about 60 weight %, and more preferred to use about 40 to about 60 weight % caustic on a dry solids basis in the first caustic treating solution.

The first caustic digestion treating time is preferably about 2 to about 16 hours, and more preferably about 2 to about 6 hours, although it can be longer. However, contacting times above 24 hours are probably unacceptable for economic reasons.

The first caustic digestion is performed at ambient pressure up to about 500 psi, preferably at about 50 to about 250 psi, although higher pressures can be used. The digestion can also be performed under an inert atmosphere, instead of air, to prevent oxidation of the shale product, although this is not essential to the practice of the invention since oxidation does not occur to a substantial extent.

The first caustic digestion is performed at about 140° to about 200° C. Below 140° C. the mineral transformation reactions of the digestion are kinetically controlled and require excessive digestion times. At temperatures above 200° C., essentially no water is present in the caustic solution which severely reduces the desired mineral transformations. It is preferred to perform the digestion at about 160° to about 185° C., and more preferred at about 170° C. to about 185° C., because over this range water vapor pressure is sufficient to maximize mineral transformations in the shale. At 160° to 185° C., the mineral transformation is equilibrium controlled, but the water concentration is at a level which ensures the transformations are high.

The weight ratio of caustic in the first caustic treating solution to the shale is about 0.75 to about 2.5. The 0.75 weight ratio is close to the amount of caustic which is stoichometrically necessary to transform silica present in the shale into cancrinite, which can subsequently be extracted. Ratios greater than about 2.5 can be used but are more costly. Examples 21–25 and Table III illustrate the weight ratio range. A preferred weight range of the caustic to shale is about 1.0 to about 1.5 as seen in results with western Colorado oil shale which showed cost-effective no decrease in ash content of the kerogen concentrate at treating ratios outside this range.

Thus the first caustic digestion preferably comprises contacting oil shale with an aqueous caustic solution of sodium hydroxide, at a temperature in the range of from about 140° C. to about 200° C., with the ratio of the weight of caustic to the weight of oil shale being in the range of from about 0.75 to about 2.5, and with the caustic concentration being in the range of from about 40 to about 60 weight %, and at a pressure of about 50 to about 250 psi.

At the end of the caustic digestion, the shale product is separated from the spent caustic treating solution, and is cooled and water washed. The amount of wash can be that equal to the amount of spent caustic solution, and is preferably a minimal amount of water to keep the spent caustic solution as a concentrated solution. The shale product can be dried before further treatment, although the shale product is preferably treated in the acid digestion while it is still damp because higher mineral extraction from the damp shale product occurs.

The shale product differs substantially from the original shale because the minerals in the shale have been substantially transformed. Table I shows the mineral transformations as determined by X-ray diffraction caused by a caustic digestion. The caustic digestions of a Colorado oil shale were performed as in the caustic digestions of Examples 1–20 using 50% on a dry solids weight basis aqueous NaOH treating solution at a temperature of about 165°–175° C. The shale product from two runs under autoclave pressure and one at atmospheric pressure were analyzed, and relative amounts of different minerals found in the starting shale were compared to those amounts in the separated shale products.

TABLE I

MINERALS IN SHALE AND KEROGEN CONCENTRATES

| Composition[a] | Quartz | Dolomite | Albite | Analcime | Calcite | Cancrinite | Tobermorite |
|---|---|---|---|---|---|---|---|
| Medium Shale[b] | Major | Major | Major | Major | Minor | — | — |
| Autoclave Product[c] | — | — | — | — | Major | Major | Major |
| Autoclave Product[c] | — | Minor | — | — | Minor | Major | Intermediate |
| Atmospheric Product[c] | — | — | — | — | Major[d] | — | — |

[a]Chemical compositions of the crystalline minerals are as follows: a-Quartz, $SiO_2$; Dolomite, $CaMg(CO_3)_2$; Albite, $NaAlSi_3O_8$; Analcime, $NaAl(SiO_3)_2—H_2O$; Calcite, $CaCO_3$; Cancrinite, $(Na,Ca,Al)_8(Si,Al)_{12}O_{24}(CO_3)_2—3H_2O$; Tobermorite, $Ca_5(OH)_2Si_6O_{16}—4H_2O$.
[b]Pass-14-mesh medium-rich shale.
[c]Medium-rich shale caustic-treated with 50% aqueous NaOH.
[d]Plus several weak unidentified peaks. Under infrared, cancrinite minerals present.

As the data show, the minerals present in the shale were substantially transformed into calcite, cancrinite and tobermorite, all of which are extractable by acid solutions and are not present in major amounts in the original shale. Although total amounts of minerals were not measured, the data show substantially complete mineral transformations caused by the caustic digestion. The same substantial mineral transformations into cancrinite, calcite and toberomite were also seen in shale products resulting from digestions at autoclave pressure with both a 25 and 35 weight % caustic treating solution.

That mineral transformations, not extractions, occur during the caustic digestion is further seen in Examples 26–29. In these, the spent caustic treating solutions and spent acid treating solutions of two shale treatments performed with the method of Examples 1–20 were analyzed by atomic absorption for mineral content. Only six out of 24 minerals had a lower concentration in the acid solution than in the caustic solution.

The mineral transformations due to the caustic digestion is an advantage of the invention. All aluminates and aluminosilicates present in shale, including feldspar, are converted in soluble forms. Thus, aluminum recovery can be made from all shales with the invention and is not restricted to Dawsonite-rich shales.

In effect, the shale product separated from the caustic digestion is a silica gel upon which acid soluble minerals and kerogen are deposited. That the shale product's structure appears to be silica gel supporting kerogan and mineral is seen in infrared analysis of the product. All bands corresponding to silica gel (3400, 1625, 1085, 950, 800, and 460 cm−1) were seen in the IR spectrum plus only those associated with kerogen. Because of the shale product's structure, it can thus be used as an active adsorbent for removing acidic and neutral sulfur-containing compounds from liquids or gases such as a flue gas.

The kerogen contained in the shale product showed some changes in elemental and IR analyses after the caustic digestion. It was expected that the severe hydrolysis conditions used in the digestion would hydrolyze the large number of ester and amide links in kerogen to produce a much different kerogen, but the changes observed were chiefly a 5–10% increases in aromatic carbon content, and some slight oxidation of sulfur present.

After the caustic digestion, the washed shale product is then treated in the acid digestion. The purpose of the acid digestion is to extract the minerals which were converted into extractible form by the caustic digestion with an aqueous acid treating solution. The acid digestion destroys the crystalline nature of the shale product to produce an amorphous first kerogen concentrate which is separate from the spent acid treating solution. The spent acid treating solution contains the extracted minerals which can be recovered.

The aqueous acid solutions useful in the acid digestion include $H_2SO_3$, $H_2SO_4$, HCl, HF, $HNO_3$, glacial acetic acid and formic acid. It is preferred to use $H_2SO_3$ because bisulfite ion does not precipitate metals, thereby preventing subsequent downstream regeneration problems. Hydrofluoric acid in particular presents possibilities of metal salt precipitation.

For any acid used, the concentration is at least about 0.5 molar. In using certain acids the concentration of the acid can affect the success of the acid digestion, as measured by ash content in the kerogen concentrate. Too low an acid concentration does not extract the extractable minerals; too high an acid concentration, on the other hand, can polymerize, instead of extracting, the silicic acid present.

Thus, for certain acids, the acid treating solution should be maintained within a concentration range of about 0.5 molar up to about 2.0 molar. Acids which should be controlled in this manner are HCl, $HNO_3$ and HF. For $H_2SO_3$, glacial acetic and formic acids however, a concentration of about 0.5 molar up to saturated solutions can be used.

$H_2SO_3$ is further preferred for the acid digestion because it does not exhibit the problems of acid concentration. However, when using above about 1.5 molar $H_2SO_3$, no additional mineral extraction occurred compared to weaker solutions. Thus, for $H_2SO_3$ the preferred concentration range is about 0.5 to about 1.5 molar.

The treating time of the acid digestion is preferably about 1 to about 3 hours, and more preferably about 2 hours. The temperature of the acid digestion was not found to be critical. The acid digestion can be performed at a temperature of about ambient up to about the boiling point of the aqueous acid treating solution used, and lower temperatures in that range are preferred.

For maximum extraction of mineral values from the shale product, vigorous stirring of a slurry of the shale product in the acid treating solution is preferred over a leach or percolation treatment. Vigorous stirring ensures that all extractable minerals and silica are swept into solution and not precipitated to remain in the kerogen concentrate.

After the digestion is terminated, the first kerogen concentrate is separated and fresh water washed. The wash is combined with the spent acid treating solution. The amount of wash is not as important as in the caustic digestion work-up because of the low acid concentrations used. The separated first kerogen concentrate is a mixture of silica gel and kerogen; the organic (non-ash) content of the concentrate can be upwards of 80%.

To obtain additional reduction in ash content, the damp or dried, and preferably damp, first kerogen concentrate is digested with the second aqueous caustic treating solution. This second caustic digestion removes chiefly silica gel from the first kerogen concentrate to produce the second kerogen concentrate of lower ash content. The second caustic digestion advantageously does not require as severe temperature, pressure, treating time and caustic conditions as the first caustic digestion.

The second caustic digestion is performed at about ambient temperature to about 120° C., and preferably about 80° C. to about 120° C. because of shorter treating time, although higher temperatures can be used. The digestion time is about ¼ to about 2 hours, and preferably ¼ to about 1 hour. The digestion is preferably performed at ambient pressure although elevated pressures can be used.

The caustic concentration in the second caustic treating solution is preferably the same as in the first caustic solution. In the preferred embodiment, the second caustic solution is the same about 10 to about 60 weight % used in the first caustic digestion. The weight caustic to weight first kerogen concentrate ratio is about 1 to about 10, and preferably about 1 to about 3.

The product second kerogen concentrate is then washed with water until the wash pH is neutral. The second concentrate is then dried, and contains upwards of about 80% organic content. For conversion of the kerogen to hydrocarbon compounds, the second concentrate can be used directly in a retorting process of lower retorting capacity than that used to retort raw shale. One advantage of this kerogen concentration sequence is the ability to produce with an additional short, less severe treatment still lower ash concentrates than that produced in Applicants' copending Application.

Figure 2:
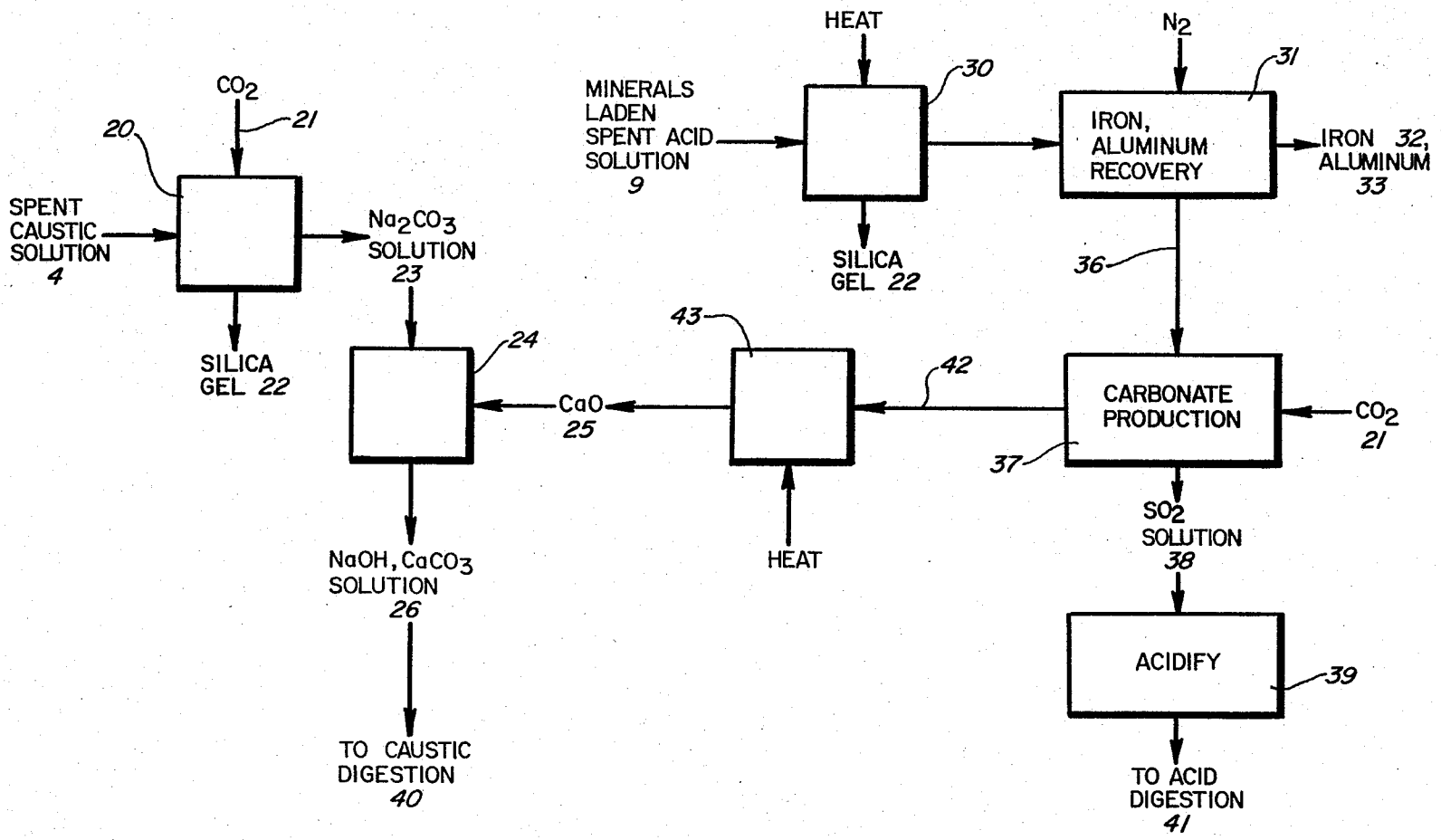
FIG. 2 shows a flow scheme for regeneration of the acid and caustic treating solutions and for recovery of minerals from the spent treating solutions.

After separating the kerogen concentrate, further improvements in the economics of the invention are yielded by recovery of the minerals contained in the spent caustic and acid treating solutions with a concomitant regeneration of the caustic and acid treating solutions. FIG. 2 shows a preferred embodiment of a regeneration and mineral recovery technique of the invention.

Spent caustic solution 4 from the first or second caustic digestions is shown as feed to silica gel production zone 20 where excess $CO_2$ 21 is bubbled into the spent caustic solution. Silica gel 22 precipitates leaving a sodium carbonate solution 23 which is sent to a caustic treating solution regeneration 24.

The mineral laden spent acid solution 9 containing, for example, aluminum, iron, and calcium enters another silica gel production zone 30 where the solution is heated to about 50°–60° C., air is bubled in and silica gel 22 precipitates. The resulting acid solution is fed into iron and aluminum recovery zone 31. Here, the pH of the solution is sequentially adjusted for selective precipitation of iron 32 and particularly aluminum 33 in a conventional manner. Other minerals where present in significant amounts are recovered in a similar manner at this point. The resulting solution 36 is then fed to carbonate production 37, where $CO_2$ 21 is bubbled into the solution, preferably under neutral to slightly basic pH, to precipitate calcium carbonate and magnesium carbonate 38. Neutral or basic pH is preferred to avoid use of large amounts of $CO_2$. The resulting $SO_2$ solution 38 is treated 39, for example by increasing acidity, to produce the acid treating solution which is returned to the acid digestion 41.

The filtered calcium carbonate and magnesium carbonate 42 is fed to alkaline earth oxide production 43, where heat is supplied to produce mainly calcium oxide 25 since only small amounts of magnesium carbonate are present in feed 42. The calcium oxide reacts with $Na_2CO_3$ 23 in caustic treating solution regeneration 24 to form sodium hydroxide and calcium carbonate solution 26. Calcium carbonate is precipitated and the sodium hydroxide solution is sent to the first and second caustic digestions 40.

The following Examples illustrate the method of the invention.

EXAMPLES 1–20

Examples 1–20 were run using a western Colorado oil shale. This shale is a lean shale having about 18.0 gallons of oil per ton (determined by modified Fischer assay). All runs started with pass-100 mesh shale. Mineral content of the lean shale included about 5.3% Al, 17.0% Si, 2.4% Fe, 3.5% K, 6.8% Ca, and 0.8% S.

The caustic digestions proceeded by mixing the 100 mesh shale in a tared, stainless steel beaker with a measured amount of 50% on a dry solid weight basis aqueous NaOH solution. In all runs, the NaOH/shale weight ratio was 1.5. The mixture was stirred until the shale was wet, about 5 minutes, the beaker was covered, and placed in a preheated oven. After a selected time, the beaker was cooled and weighed to determine water lost during the caustic digestion. The resulting shale product was then filtered and water washed. The time, temperature and water loss of each run are shown in Table 2.

The damp shale products were passed through a No. 14 sieve and then treated with acid digestions with sulfurous acid. The acid concentration and the acid digestion procedure for each example are listed in Table 2. Seven digestion procedures were used: (1) the shale product was washed repeatedly with acid; (2) excess $SO_2$ was bubbled through a water slurry of shale product, and the solids were filtered and washed with 1.0 molar $H_2SO_3$ and water; (3) as in (2) except the slurry was also stirred; (4) the shale product was slowly stirred with acid solution and the supernatant liquid was filtered off; (5) as in (2) except the shale product was treated in a percolation column; (6) as in (5) except the final $H_2SO_3$ wash was omitted; and (7) damp shale product was rapidly stirred with excess 1.0 molar $H_2SO_3$, filtered, again stirred with acid, and then fresh water washed. The resulting kerogen concentrate for each run was then filtered, air dried, and its ash content was measured. The ash contents are in Table 2.

TABLE 2

EFFECT OF CAUSTIC-TREATMENT ON KEROGEN QUALITY

| | Caustic-Treatment | | | Acid-Treat. | | |
|---|---|---|---|---|---|---|
| Run | Time, hrs. | Temp., °C. | % $H_2O$ off | Conc. | Procedure | % Ash |
| 1 | 16.5 | 171 | 82.5 | Sat. | 5 | 45.4 |
| 2 | 16.0 | 180 | 92.2 | " | 6 | 59.5 |
| 3 | 18.0 | 175 | 93.1 | 1.0 M | 1 | 60.2 |
| 4 | " | " | 90.6 | 1.0 M | 1 | 54.3 |
| 5[b] | " | " | 97.6 | Sat. | 2 | 73.6 |
| 6[b] | " | " | 99.6 | " | 2 | 65.1 |
| 7[b] | " | " | 98.2 | " | 2 | 69.4 |
| 8[b] | " | " | 99.7 | " | 2 | 71.4 |
| 9[b] | " | " | 99.6 | " | 2 | 71.5 |
| 10[c] | 18.5 | " | 101.9 | "[c] | 2 | 70.3 |
| 11 | 16.0 | 170 | 98.8 | " | 2 | 70.1 |
| 12 | 5.3 | 180 | 81.1 | " | 2 | 71.8 |
| 13 | 5.1 | 185 | 81.8 | " | 3 | 68.5 |
| 14 | 4.8 | 190 | 81.6 | 1.0 M | 1 | 52.7 |
| 15 | 16.0 | 161 | 86.7 | " | 3 | 44.5 |
| 16 | 57.5 | 153 | 82.1 | " | 3 | 48.0 |
| 17 | 30.0 | 160 | 87.5 | " | 4 | 63.9 |
| 18 | 40.0 | 165 | 84.2 | " | 4 | 65.6 |
| 19 | 40.0 | " | 84.0 | " | 7 | 26.9 |

TABLE 2-continued

EFFECT OF CAUSTIC-TREATMENT ON KEROGEN QUALITY

| | Caustic-Treatment | | | Acid-Treat. | | |
|---|---|---|---|---|---|---|
| Run | Time, hrs. | Temp., °C. | % $H_2O$ off | Conc. | Procedure | % Ash |
| 20 | 22.9 | 175 | 88.4 | " | 7 | 24.1 |

Figure 3:
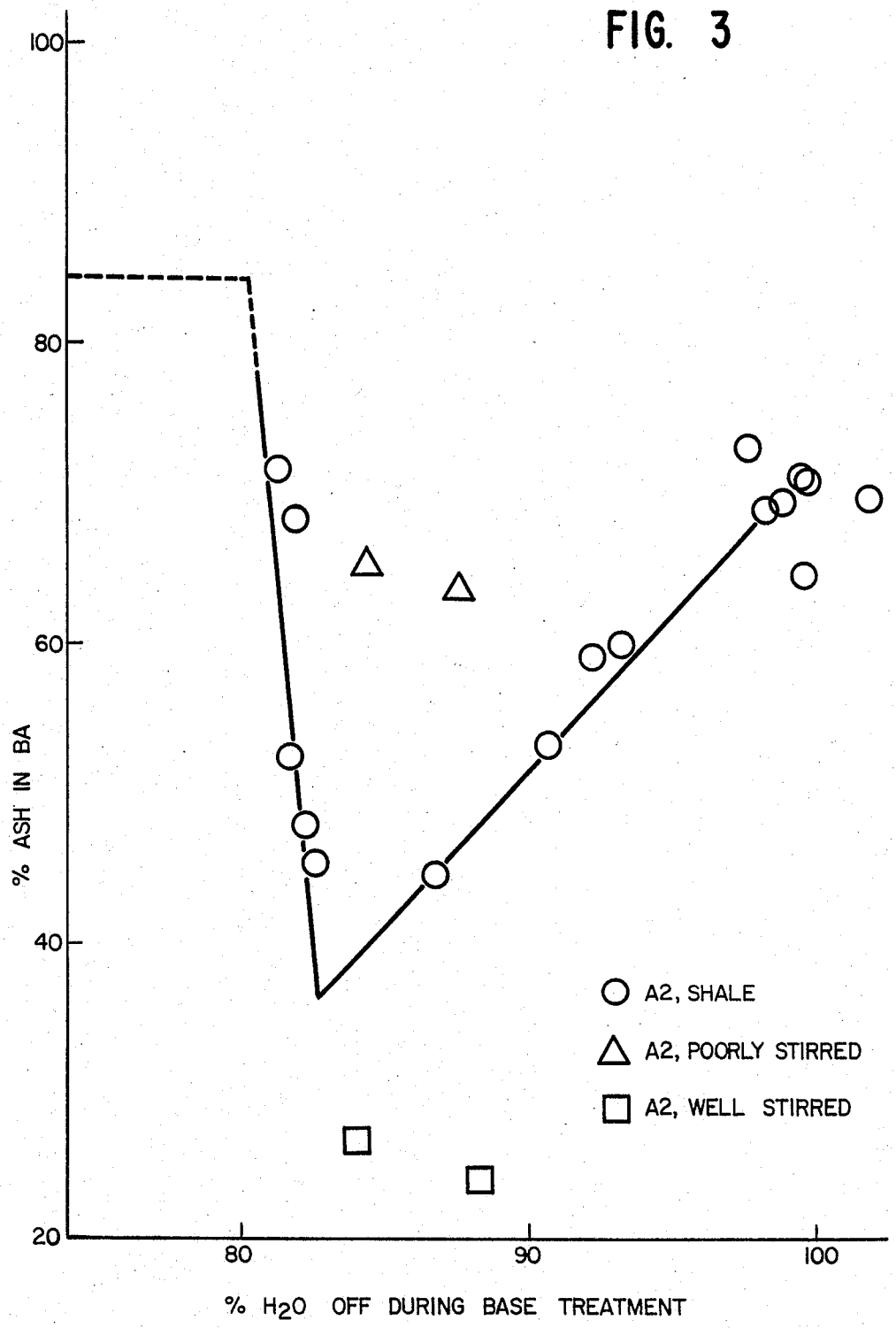
FIG. 3 shows a plot of the correlation between water concentration in the caustic digestion and the ash content of the first kerogen concentrate.

[a]Weight loss expressed as percent of $H_2O$ in caustic solution charged.
[b]Shale product was washed with dilute NaOH solution instead of with $H_2O$.
[c]Acetone water mixture saturated with $SO_2$ FIG. 3 is a plot of percent water lost during the caustic digestion versus the percent ash in the kerogen concentrate. As seen in FIG. 3, when the percent water lost is between about 82 to 90%, the ash content is relatively the lowest. These results indicate that the desired ash content is obtainable by control of water concentration during the first base digestion. Later Examples 30–44 will show that ash content is reducible to below 20% with the caustic-acid-caustic procedure.

A comparison of Examples 17–18 to 19–20 also show the effect of vigorous stirring during the acid digestion. At about the same water loss condition, 17 and 18, poorly stirred, had much greater ash content than 19 and 20, vigorously stirred. Vigorous stirring or contact during the acid digestion thus yields lower ash content.

EXAMPLES 21–25

Examples 21–25 demonstrate the effect of the caustic solution to shale weight ratio using the same shale in the above examples. The caustic digestions were performed as in Examples 1–20 but were performed at 165° C. for 17 hours. The acid digestions were by stirring well with 1.0M $H_2SO_3$. Table 3 shows the weight ratio, and the % ash and % unextracted aluminum in the first kerogen concentrate. As can be seen, at a weight ratio below 0.75, the ash and unextracted aluminum content remains high.

TABLE III

EFFECT OF CAUSTIC-TO-SHALE RATIO ON ASH CONTENT

| Run | NaOH/Shale | % Ash | % Unextracted Al |
|---|---|---|---|
| 21 | 1.5 | 27 | 1.1 |
| 22 | 1.0 | 31 | 3.1 |
| 23 | .75 | 31 | 3.4 |
| 24 | .5 | 68 | 34 |
| 25[a] | .5 | 60 | 22 |

[a]Higher severity run: 17 hrs. at 180° C.

EXAMPLES 26–29

These examples illustrate that no substantial extraction of minerals from shale occurs during the first caustic digestion. Examples 26–29 are atomic absorption analysis of the spent caustic treating solution from the first caustic digestion and spent acid solutions, respectively, from two separate shale treatments. Examples 26 and 29 are from a shale treatment wherein the acid digestion used 1.0M $H_2SO_3$, and 27 and 28 from the other wherein the acid digestion used 1.0N HCl. The caustic digestions were performed as in Examples 1–20 with 50% NaOH solution, 1.5 NaOH/shale ratios and at 165° for 17 hours. The acid digestions were performed by stirring a slurry of the shale products with the acid. Examples 26 and 27 are analysis of the spent acid solutions, and Examples 28 and 29 are of the spent caustic solutions. Table IV lists the parts per million parts concentration of twenty-five elements which are in the minerals present in raw shale. The ppm's listed are based on an equal volume of spent treating solution.

TABLE IV

| Example | Zn | Mn | Pb | Cd | Cr | Fe |
|---|---|---|---|---|---|---|
| 26 | 1.85 | 3.41 | 1.39 | 0.067 | 4.25 | 230 |
| 27 | 2.99 | 11.9 | 3.11 | 0.132 | 78 | 700 |
| 28 | 1.06 | 0.058 | 0.52 | 0.045 | 0.075 | 2.62 |
| 29 | 0.485 | 0.039 | 0.52 | 0.045 | 0.113 | 1.25 |
| V | Co | Cu | Ni | K | Li | |
| 26 | 0.181 | 0.117 | 3.06 | 1.56 | 5.1 | 0.29 |
| 27 | 0.55 | 0.91 | 1.91 | 34.5 | 11.2 | 0.60 |
| 28 | 0.77 | 0.075 | 0.30 | 0.10 | 88 | 0.55 |
| 29 | 0.56 | 0.075 | 0.30 | 0.10 | 50 | 0.35 |
| Ca | Mo | Mg | Al | Ti | P | |
| 26 | 960 | 0.085 | 400 | 285 | 12.8 | 2.22 |
| 27 | 1260 | 0.347 | 590 | 600 | 24.5 | 4.33 |
| 28 | 0.67 | 0.68 | 0.52 | 16.8 | 0.18 | 4.85 |
| 29 | 1.26 | 0.227 | 0.64 | 57 | 0.18 | 3.42 |
| Si | B | Ba | Se | Sb | Sr | |
| 26 | 700 | 6.2 | 0.64 | 1.06 | 0.84 | 5.6 |
| 27 | 1120 | 5.8 | 10.9 | 3.42 | 1.99 | 8.7 |
| 28 | 670 | 8.5 | 0.045 | 0.83 | 0.45 | 0.030 |
| 29 | 480 | 8.8 | 0.045 | 0.83 | 0.45 | 0.030 |

As is seen in the Table, all elements but vanadium, potassium, lithium (one run), molybdenum, silicon, and boron had higher concentrations in the acid solution than in the caustic solution. In particular, iron, aluminum, magnesium and calcium show much greater concentration in the spent acid. Approximate material balances showed that about 50% silica is extracted into the caustic along with about 86% of the associated potassium; iron, calcium and magnesium were not extracted into the caustic; and aluminum showed 5% (one run) and 25% (the other) extraction into the caustic. The results show no substantial extraction of minerals, particularly non-siliceous minerals, into the first caustic treating solution.

EXAMPLES 30–34

Examples 30–34, detailed in Table V, show the preparation of a kerogen concentrate having less than 20% ash content with the method of the invention. The second caustic digestions of the first kerogen concentrate obtained in Examples 2, 5, and 7 are shown in Table V, and all used 50% by weight aqueous NaOH solution, 1 atmosphere pressure, and an air atmosphere. The procedure used was to mix the powdered first kerogen concentrate thoroughly with the aqueous NaOH solution for about 5 minutes in a stainless steel beaker. The beaker was then placed in an oven for the desired time. The product second kerogen concentrate is then mixed with water, filtered, water washed, and dried.

Shown in the Table are the first kerogen concentrate's origin, weight of first concentrate, time and temperature, weight NaOH solution, NaOH/concentrate ratio, and the weight, yield and % ash of the second kerogen concentrate.

TABLE V

| | | SECOND CAUSTIC-DIGESTION | | | | | Second Kerogen Concentrate | | |
|---|---|---|---|---|---|---|---|---|---|
| Run | From Example No. | Time, hrs. | Temp., °C. | Concentrate, gr. | Wt., g NaOH Sol. | Weight Ratio | Wt., gr | % Yield | % Ash |
| 30 | 2 | 0.5 | 120 | 2.0 | 15.0 | 3.8 | 0.60 | 30 | 19.9 |
| 31 | 2 | 0.5 | 120 | 1.0 | 15.0 | 5.0 | 0.29 | 29 | 18.0 |
| 32 | 2 | 0.5 | 120 | 1.0 | 15.0 | 7.5 | 0.29 | 29 | 12.5 |
| 33 | 5 | 1.0 | 120 | 25.0 | 38.0 | 0.76 | 12.5 | 50 | 12.1 |
| 34 | 7 | 1.0 | 120 | 25.0 | 38.0 | 0.76 | 5.8 | 23.0 | 12.0 |

As seen in the % ash, all runs had organic content greater than 80%, and three with organic content greater than 85%. The method of the invention can successfully prepare a kerogen concentrate of less than 20% ash content.

EXAMPLE 35

A mixture of 580 g. powdered Colorado oil shale and 900 cc of 50% aqueous NaOH was charged to a stainless steel liner in a two-gallon autoclave, with water outside the liner. The autoclave was sealed and heated for about 30 hours at 95°–155° C., at a maximum pressure of 210 psig. The cooled shale product was water washed to yield 484 gr. A 50 gram portion of the shale product was leached with acid, first with 20% acetic acid, then with concentrated HCl to obtain 19.9 gr. first kerogen concentrate. Two grams of this were charged to a Hoke pressure vessel with 7 gr. 50% aqueous NaOH, and heated for about four hours at 150° C. at a pressure of 255 psig. The second kerogen concentrate yield was 0.7 gr as a light brown solid. Analysis of the second concentrate showed it contained 70.12% carbon, 8.56% hydrogen, 2.07% nitrogen, and 6.22% oxygen.

EXAMPLE 36

A mixture of 20.0 gr. powdered Colorado oil shale with 97.1 gr. 50% aqueous NaOH was placed in a Hoke vessel and heated under a nitrogen atmosphere at 179° C. and 880 psig for 24 hours. The cooled shale product yield was 15.95 g. A 7.03 g. portion was leached with dilute acetic acid and concentrated HCl to 3.16 g. first kerogen concentrate. A two gram portion of this was placed with 14 g. of 25% aqueous NaOH in a Hoke vessel and heated for four hours at a temperature of 150° C. and pressure of 250 psig. The second kerogen concentrate was a light brown solid of 0.90 gr and was analyzed as 70.40% carbon, 8.41% hydrogen, 2.04% nitrogen, and 6.42% oxygen.

Examples 35 and 36 show the method of the invention using elevated pressures and lower caustic concentrations in the two caustic digestions to produce a second kerogen concentrate of less than 20% ash content.

EXAMPLES 37–44

Runs 37–44 started with the same lean shale in Examples 1–20. The experimental procedure for the first caustic digestion and the acid digestion was as in Examples 1–20, and the details are in Table VI. The resulting first kerogen concentrates were oven dried at 105° C. for four hrs., and then treated in a second caustic digestion. The conditions of the second caustic digestion are in Table VII.

TABLE VI

EFFECT OF CAUSTIC-TREATMENT ON KEROGEN QUALITY

| | First Caustic-Digestion | | | Acid Digestion | | | |
|---|---|---|---|---|---|---|---|
| Run | Time, hrs. | Temp., °C. | Caustic/ Shale | Kind | Conc. | % Yield | % Ash |
| 37 | 40 | 165 | 1.5 | $H_2SO_3$ | 1.0 m | 9.3 | 26.9 |
| 38 | 23 | 175 | 1.5 | $H_2SO_3$ | 1.0 m | 9.9 | 24.1 |
| 39 | 17 | 162 | 1.0 | $H_2SO_3$ | 1.0 m | 9.7 | 30.8 |
| 40 | 5.3 | 180 | 1.5 | $H_2SO_3$ | Sat. | 34.4 | 71.8 |
| 41 | 30 | 160 | 1.0 | $H_2SO_3$ | 1.0 m | 23.1 | 63.9 |
| 42 | 4 | 175 | 1.5 | $H_2SO_3$ | 0.1 m | 13.5 | 22.8 |
| 43[a] | 24 | 175 | 0.5 | $H_2SO_3$ | Sat. | 73.2 | 71.2 |
| 44[b] | 25 | 178 | 0.5 | $H_2SO_3$ | Sat. | 49.4 | [c] |

[a]35% NaOH solution at 140–150 psi autoclave pressure.
[b]35% NaOH solution at 135 psi autoclave pressure.
[c]not determined.

TABLE VII

SECOND CAUSTIC DIGESTION

| | | | | Second Kerogen Concentrate | |
|---|---|---|---|---|---|
| Run | Weight Ratio | Time hr. | Temp. °C. | % Yield[a] | % Ash |
| 37 | 6 | 1 | 123 | 74 | 10 |
| 38 | 5.5 | 1 | 123 | 80 | 12 |
| 39 | 5.5 | 1 | 123 | 84 | 15.8 |
| 40 | 1.0 | 1 | 120 | 26 | 14.1 |
| 41 | 5 | 1 | 123 | 56 | 16.3 |
| 42 | 3.8 | ½ | 120 | 104 | 13.1 |
| 43 | 5 | 1 | 137 | 25.1 | 11.0 |
| 44 | 5 | ½ | 137 | 25.4 | 9.7 |

[a]Yield based only on second caustic digestion.

As seen in Table VII, the second kerogen concentrates produced in runs 37–44 had low ash contents ranging from 9.7% to 16.3%, or high organic contents of 83.7% to 90.3%. These second kerogen concentrates also had ash contents much lower than those of the corresponding first kerogen concentrates, compare to the % ash values in Table VI. In all runs, the second caustic digestion was under milder conditions than the first caustic digestion, compare Table VI and Table VII caustic conditions.

The above examples and specification are intended as merely illustrative; the full scope of the invention is given by the claims.

We claim:

1. A method for treating oil shale containing kerogen comprising treating oil shale with a first aqueous caustic treating solution at a temperature in the range of from about 140° C. to 200° C. under treating conditions sufficient to transform minerals present in the oil shale into extractable forms to produce a shale product of transformed mineral content; treating the shale product with an aqueous acid solution to produce a first kerogen concentrate; and treating the first kerogen concentrate with a second aqueous caustic solution to produce a second kerogen concentrate of low ash content.

2. The method of claim 1 wherein caustic concentration in the first and second caustic treating solutions is about 10 to about 60 weight %.

3. The method of claim 1 wherein treating temperature is about 160° to about 180° C.

4. The method of claim 1 wherein the sufficient treating conditions comprise a pressure of atmospheric to about 200 psi.

5. The method of claim 1 wherein weight ratio of caustic on a dry solids weight basis in the first caustic treating solution to oil shale is about 0.75/1.0 to about 2.5/1.0.

6. The method of claim 1 wherein the aqueous acid solution has an acid concentration of at least 0.5 molar.

7. The method of claim 6 wherein the caustic in the first and second caustic treating solutions is sodium hydroxide.

8. The method of claim 7 wherein caustic concentration in the aqueous caustic treating solutions is about 40 to about 60 weight %.

9. The method of claim 1 wherein the acid solution is aqueous $H_2SO_3$.

10. The method of claim 9 wherein $SO_2$ is bubbled into a slurry of the shale product and water.

11. The method of claim 7 wherein the acid solution is $H_2SO_3$.

12. The method of claim 1 wherein the caustic in the first and second caustic treating solutions is selected from the group consisting of sodium hydroxide, lithium hydroxide, potassium hydroxide, calcium hydroxide, sodium sulfide, sodium tetrasulfide, sodium hydrosulfide, sodium carbonate, sodium bicarbonate, and sodium silicate.

13. The kerogen concentrate produced by the method of claim 1.

14. The method of claim 1 wherein treating temperature with the second caustic treating solution is about 80° C. to about 135° C.

15. The method of claim 1 wherein the ratio of second caustic treating solution to first kerogen concentrate is about 1.0 to about 10.0.

16. The method of claim 1 wherein the first and second caustic treating solutions are the same.

* * * * *